US006626657B1

(12) United States Patent
Miani et al.

(10) Patent No.: US 6,626,657 B1
(45) Date of Patent: Sep. 30, 2003

(54) SPINNERET HOLDER ASSEMBLY FOR PRODUCING A CONTINUOUS PLASTIC MULTIPLE-COMPONENT YARN WITH A PRESET COMPONENT RATIO

(76) Inventors: Mario Miani, Via Enrico Fermi, 9, 20017 Rho (IT); Paola Miani, Via Pace 47, 20017 Rho (IT)

( * ) Notice: Subject to any disclaimer, the term of this patent is extended or adjusted under 35 U.S.C. 154(b) by 0 days.

(21) Appl. No.: 09/595,446

(22) Filed: Jun. 16, 2000

(30) Foreign Application Priority Data

Jul. 1, 1999 (IT) ..... MI99A1460

(51) Int. Cl.[7] ..... D01D 4/06; D01D 5/30

(52) U.S. Cl. ..... 425/131.5; 264/172.14; 264/172.15; 425/192.5; 425/463

(58) Field of Search ..... 425/131.5, 192.5, 425/382.2, 463; 264/172.13, 172.14, 172.15

(56) References Cited

U.S. PATENT DOCUMENTS 3,559,237 A * 2/1971 Van Den Biggelaar et al. ..... 264/172.14
3,692,423 A * 9/1972 Okamoto et al. ..... 264/172.13
3,725,192 A * 4/1973 Ando et al. ..... 138/141
3,792,944 A * 2/1974 Chimura et al. ..... 425/131.5
3,963,406 A 6/1976 Reker ..... 425/463
4,370,114 A * 1/1983 Okamoto et al. ..... 425/131.5
4,842,503 A 6/1989 Judge ..... 425/72.2
5,017,116 A 5/1991 Carter et al. ..... 425/131.5
5,466,142 A * 11/1995 Miani ..... 264/172.11
5,562,930 A * 10/1996 Hills ..... 264/172.11
6,120,276 A * 9/2000 Balk ..... 264/172.15

* cited by examiner

*Primary Examiner*—James P. Mackey
*Assistant Examiner*—Joseph Leyson
(74) *Attorney, Agent, or Firm*—Guido Modiano; Albert Josif; Daniel O'Byrne

(57) ABSTRACT

A spinneret holder assembly for producing a continuous plastic multiple-component yarn with a preset component ratio, comprising in a mutually superimposed arrangement: a plate for conveying a first component and at least one second component; a distribution plate with first channels for the passage of the first component and a first compensation element for the second component; a pre-spinneret with second channels for the passage of the first component which are aligned with the first channels and a second compensation element for the second component; and a spinneret with extrusion holes which are connected to the channels for the passage of the first component and extend from a region for the distribution of the second component. The paths followed by the first component and the second component are different one another and the load loss of the various paths that are covered is identical for each component, so as to obtain a constant ratio between the components of each filament that leaves the spinneret.

5 Claims, 6 Drawing Sheets

SPINNERET HOLDER ASSEMBLY FOR PRODUCING A CONTINUOUS PLASTIC MULTIPLE-COMPONENT YARN WITH A PRESET COMPONENT RATIO

BACKGROUND OF THE INVENTION

The present invention relates to a spinneret holder assembly for producing a continuous plastic multiple-component yarn with a preset component ratio.

It is known that conventional spinneret holder assemblies for single-component products, used in continuous-type extrusion heads, are substantially constituted by three superimposed plates joined by bolts which can be assembled in a suitable seat formed in the extrusion head.

The three plates that are used are constituted by a first plate, which conveys the melted plastic material from the head into the extrusion pack through a hole which is generally located at the center of the plate; a second plate, which is constituted by a border which adheres to the upper plate, preventing the escape of the polymer that flows between the two plates; and a perforated region inside the border which distributes the material over the underlying plate; there is also provided a third plate, known as spinneret, which is designed to convey the polymer through a very specific number of holes in order to obtain a corresponding number of filaments which constitute the continuous yarn after cooling.

Moreover, meshes are generally provided above the second plate and are designed to filter the polymer.

When it is necessary to produce a two-component continuous yarn, a relatively large number of plates is interposed between the first plate, which generally has two inlets, and the spinneret, in order to appropriately guide the two components so that the two components reach each hole of the spinneret in the same quantitative ratio.

In order to achieve this result and ensure that the same amount of each component reaches each hole, current solutions use paths, for both components, which always have the same length and cross-section, so that the quantitative ratios assuredly remain unchanged.

This kind of solution entails an extremely complicated mechanical structure which arises from a large number of mutually superimposed and assembled plates and in which it is necessary to form a plurality of channels, so as to achieve the intended conveyance of the components.

SUMMARY OF THE INVENTION

The aim of the present invention is to solve the above-cited problem, providing a spinneret holder assembly which allows to produce a continuous multiple-component yarn without thereby requiring a large number of plates.

Within the scope of this aim, an object of the present invention is to provide a spinneret holder assembly in which it is possible to preset the quantitative ratios between the two components, with the assurance that each component is present in the final yarn always in the same quantitative ratio.

Another object of the present invention is to provide a spinneret holder assembly which, thanks to its particular constructive characteristics, is capable of giving the greatest assurances of reliability and safety in use.

Another object of the present invention is to provide a spinneret holder assembly which can be easily obtained starting from commonly commercially available elements and materials and is also competitive from a merely economical point of view.

This aim, these and other objects which will become better apparent hereinafter are achieved by a spinneret holder assembly for producing a continuous plastic multiple-component yarn with a preset component ratio, according to the present invention, characterized in that it comprises, in a mutually superimposed arrangement: a plate for conveying a first component and at least one second component; a distribution plate with first channels for the passage of said first component and a first compensation element for said second component; a pre-spinneret with second channels for the passage of said first component which are aligned with said first channels and a second compensation element for said second component; and a spinneret with extrusion holes which are connected to said channels for the passage of said first component and extend from a region for the distribution of said second component; the paths followed by said first component and said at least one second component being different one another and the load loss of the various paths that are covered being identical for each component, for a constant ratio between the components of each filament that leaves said spinneret.

BRIEF DESCRIPTION OF THE DRAWINGS

Further characteristics and advantages of the present invention will become better apparent from the following detailed description of a preferred but not exclusive embodiment of a spinneret holder assembly for producing a continuous plastic multiple-component yarn with a preset component ratio, illustrated only by way of non-limitative example in the accompanying drawings, wherein.

DESCRIPTION OF THE PREFERRED EMBODIMENTS

Figure 1:
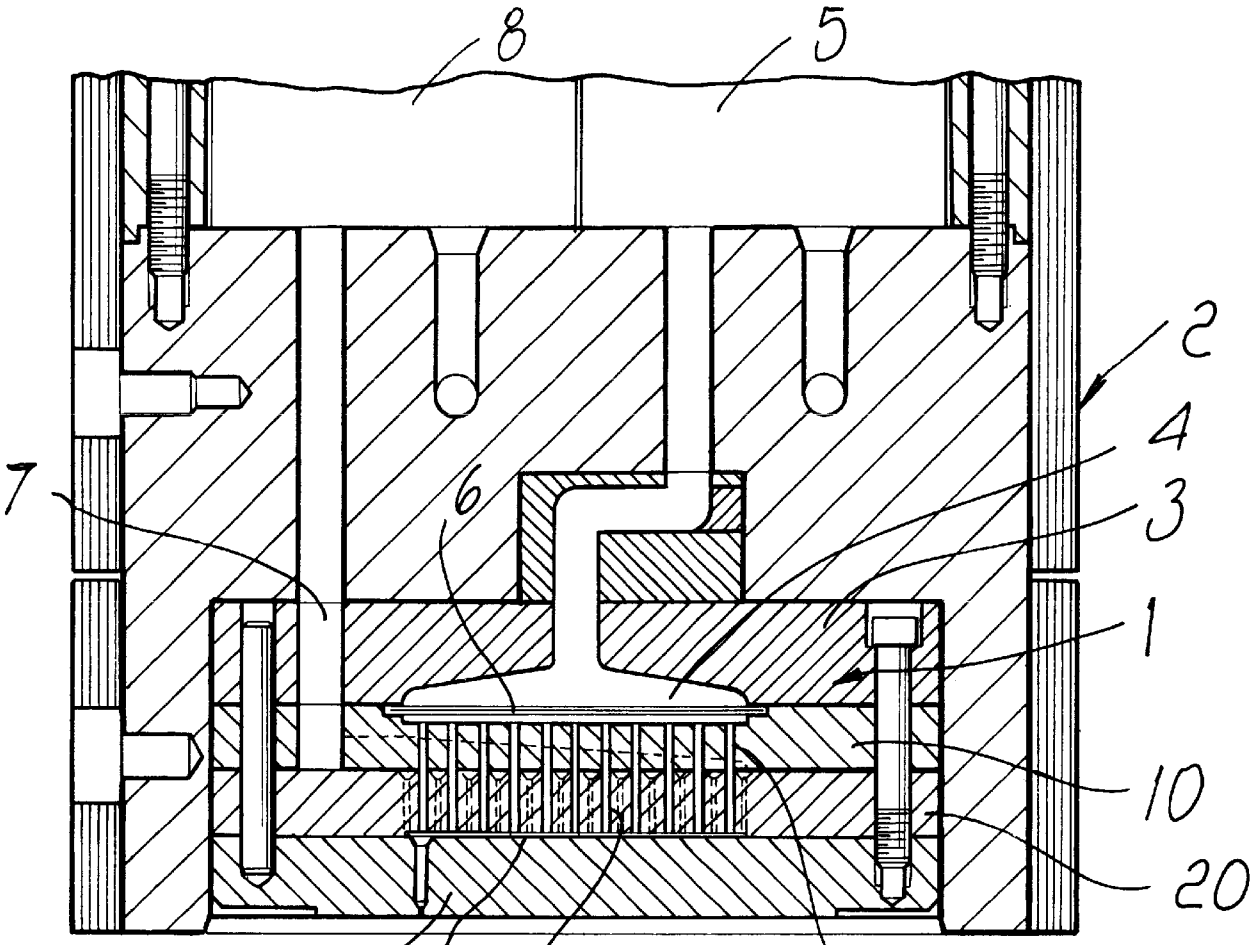
FIG. 1 is a schematic sectional view of a spinneret holder assembly coupled to an extrusion head, according to the present invention.
Figure 2:
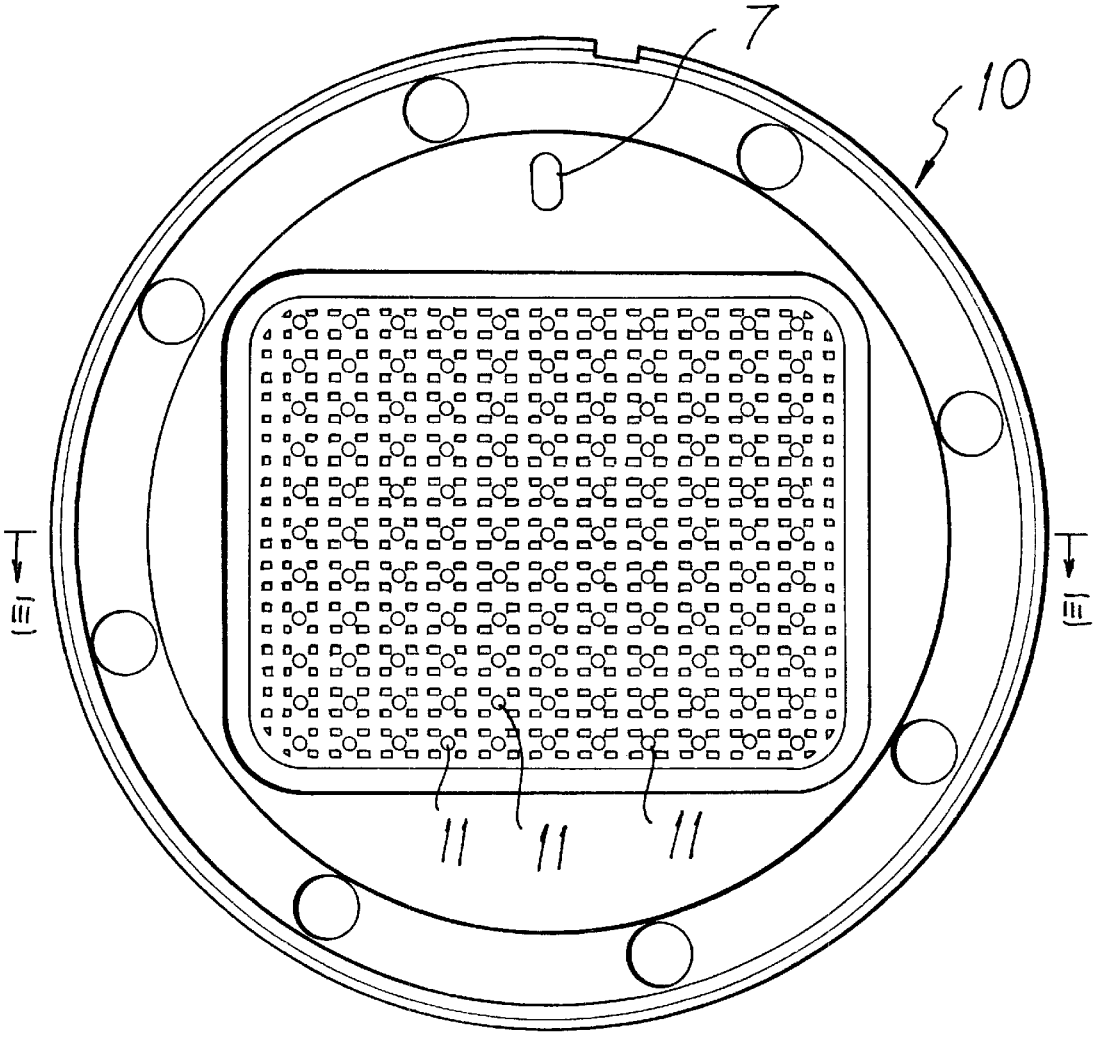
FIG. 2 is a top plan view of the distribution plate.
Figure 3:
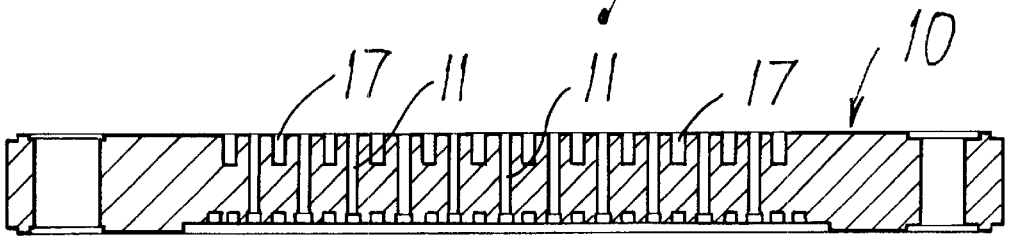
FIG. 3 is a sectional view, taken along the line III—III of FIG. 2.
Figure 5:
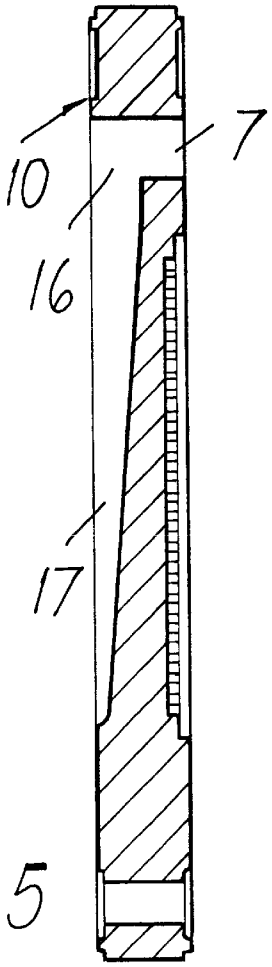
FIG. 5 is a sectional view, taken along the line V—V of FIG. 4.

With reference to the above figures, the spinneret holder assembly for producing a continuous multiple-component plastic yarn with a preset component ratio, generally designated by the reference numeral 1, can be connected in a per se known manner to an extrusion head, generally designated by the reference numeral 2.

The spinneret holder assembly comprises a conveyance plate 3 which forms a distribution element 4 into which a first component is fed by means of a first pump 5.

In a per se known manner, a mesh 6 for filtering the polymer is arranged inside the distribution element 4.

The conveyance plate 3 forms a first duct 7 for the passage of a second component, which is fed by means of a second pump, designated by the reference numeral 8.

The conveyance plate 3 is superimposed on a distribution plate 10 in which first channels 11 are provided for the passage of the first component through the plate.

Figure 4:
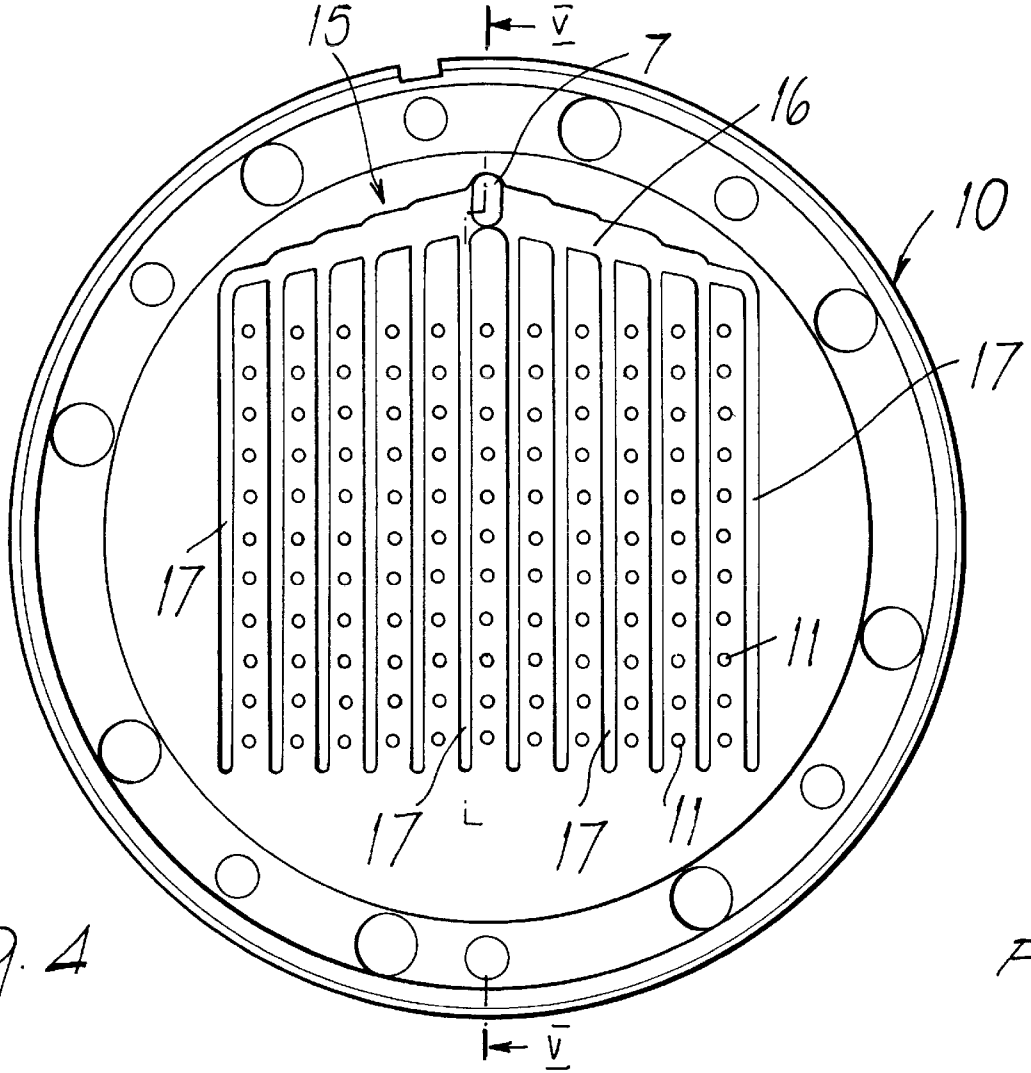
FIG. 4 is a bottom view of the distribution plate.
Figure 6:
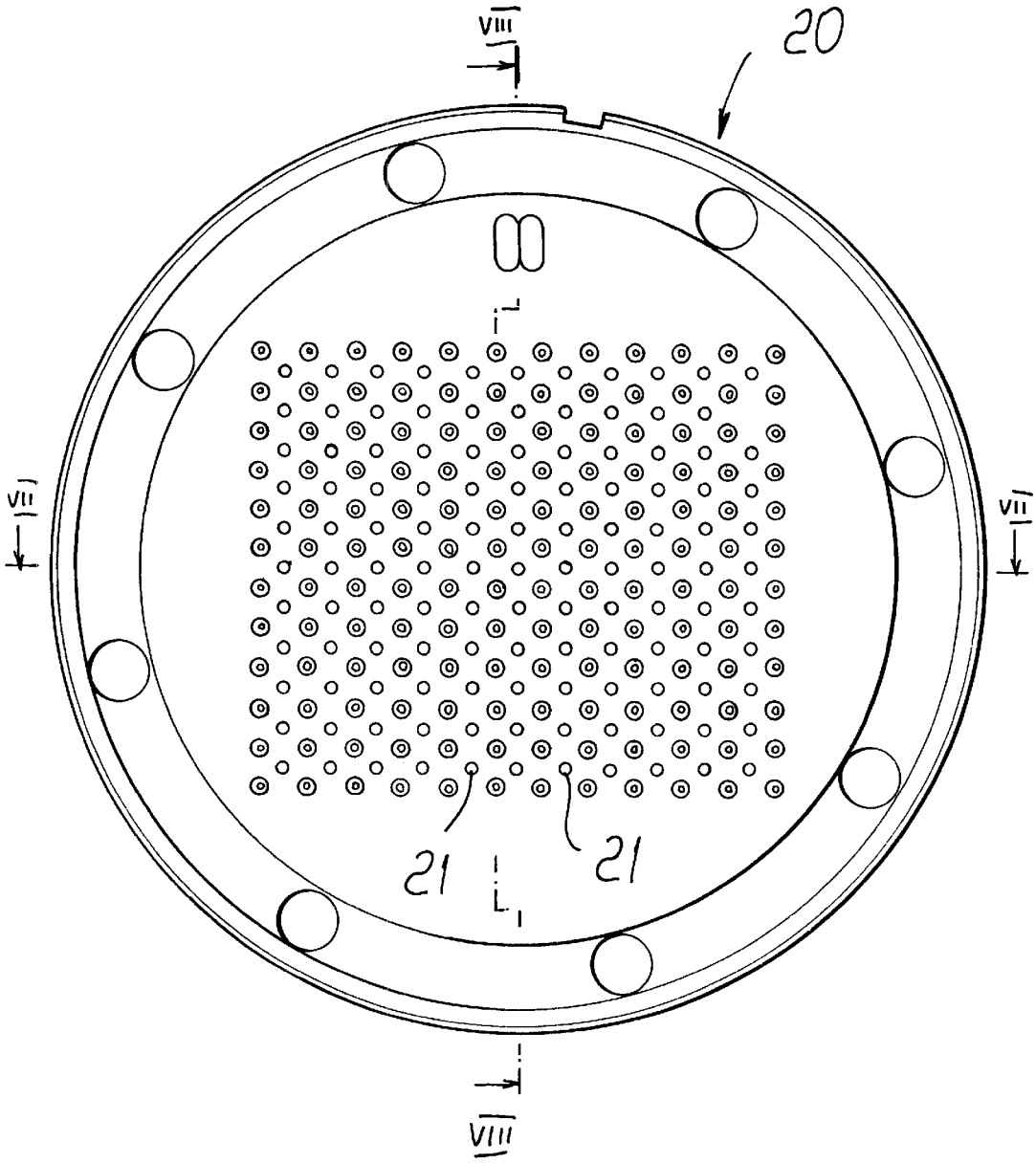
FIG. 6 is a top plan view of the upper face of the pre-spinneret.
Figure 8:
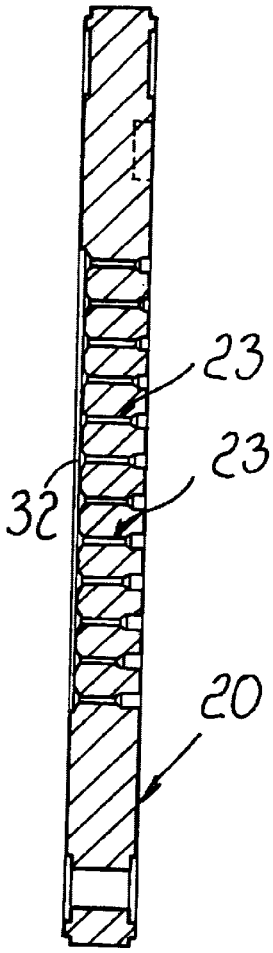
FIG. 8 is a sectional view, taken along the line VIII—VIII of FIG. 6.

A first compensation element is also provided, designated by the reference numeral 15, as shown more clearly in FIG. 4, for the second component.

The first compensation element 15 is constituted by a V-shaped manifold 16, at the apex of which the duct 7 for feeding the second component is connected.

A plurality of distribution branches 17 extend from the manifold and have a continuously variable cross-section, so that the intended amount of polymer assuredly reaches each branch formed in the distribution plate.

This is achieved by appropriately dimensioning the polymer passage region that leads from the inlet in the distribution plate to each one of the distribution branches; more specifically, the dimensions, i.e., the lengths and cross-sections of the path, are such that the pressure loss of the polymer, for the intended flow-rates, is identical from the point of entry into the plate up to the outlet leading to the spinneret.

The distribution branches 17 are interposed between the first passage channels 11 and do not interfere with them.

The distribution plate is superimposed on a pre-spinneret, designated by the reference numeral 20, in which second passage channels 21 are formed in axial alignment with the first channels 11 for the passage of the first component.

The second component, which arrives from the distribution branches, encounters the second compensation element 22, which is designed to ensure that the same amount of polymer reaches each hole of the spinneret from each distribution branch.

Figure 9:
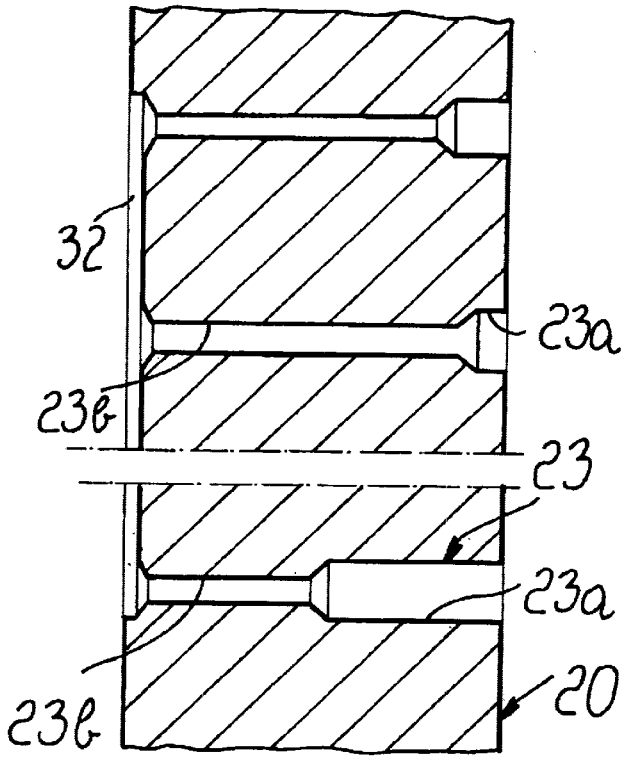
FIG. 9 is a highly enlarged-scale view of the detail of FIG. 8, illustrating the variable-section channels.
Figure 7:
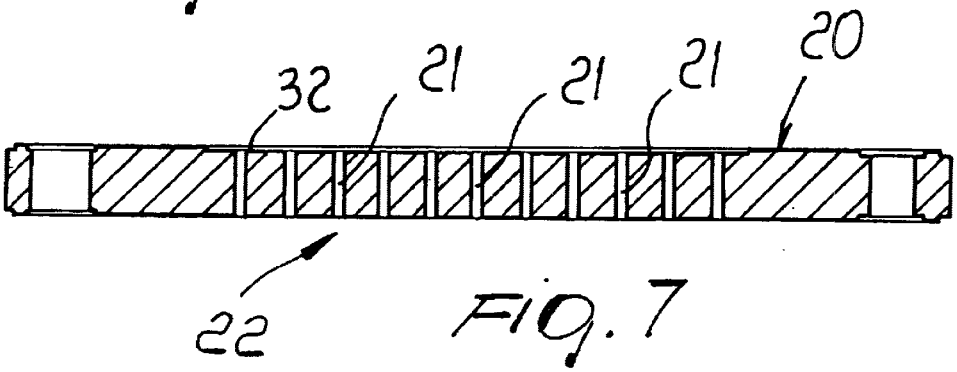
FIG. 7 is a sectional view, taken along the line VII—VII of FIG. 6.
Figure 10:
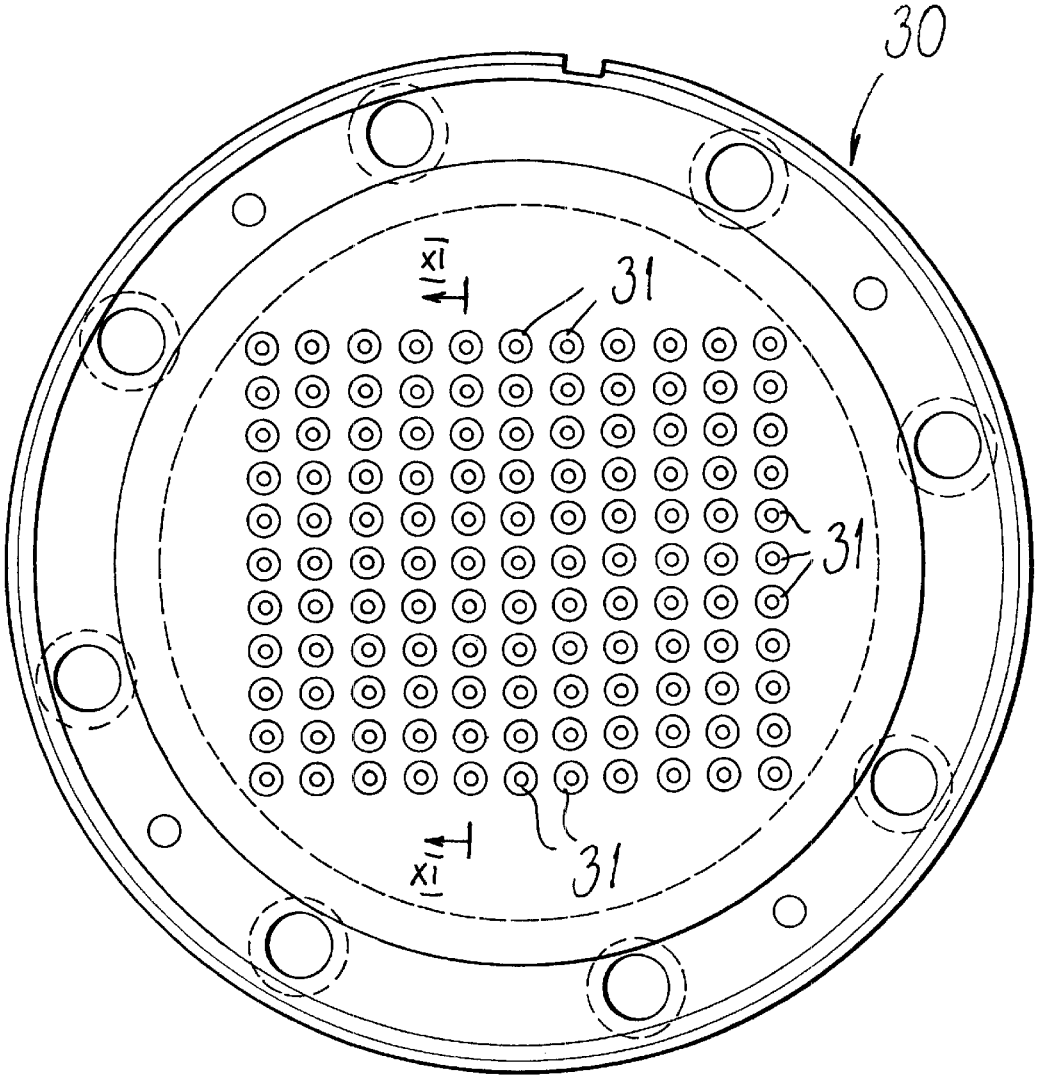
FIG. 10 is a top view of the spinneret.

This is achieved by providing holes 23 for the transfer of the second component from the distribution branches of the distribution plate to the underlying spinneret which all have the same length and variable cross-sections; more specifically, as shown in FIG. 9, the transfer holes 23 have a portion 23*a* which has a larger cross-section, preferably four times larger, and a portion 23*b* which has a narrower cross-section, and the axial extension of the portions varies according to their position with respect to the distribution branching; more specifically, the length of the portion 23*b* having a smaller cross-section decreases from the inlet toward the end of the corresponding distribution branch.

The length of the hole 23 having the smaller cross-section is calculated so as to compensate for the lower pressure that is present in the distribution branch 17 as the polymer advances from the inlet to the end of the distribution branch.

The calculation of the cross-sections is such that the flow of an identical amount of polymer produces the same load loss from the inlet of the distribution branch to the outlet of each one of the transfer holes.

The same result can be achieved by replacing the portion of hole having a larger cross-section with a continuous slot along the entire distribution channel.

Figure 12:
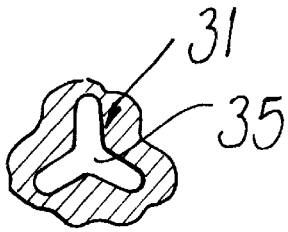
FIG. 12 is an enlarged-scale sectional view, taken along the line XII—XII of FIG. 11.
Figure 11:
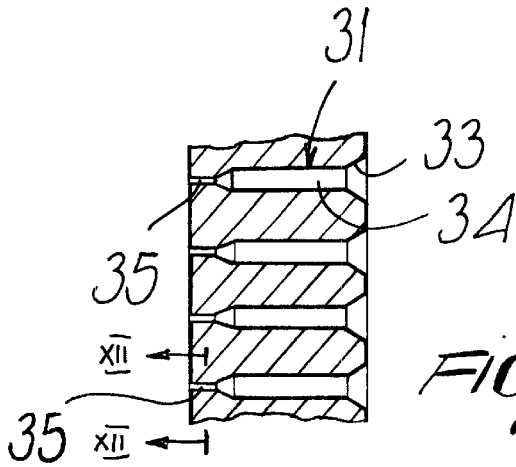
FIG. 11 is a schematic partial sectional view, taken along the line XI—XI of FIG. 10.

Moreover, the spinneret holder assembly is completed by a spinneret, designated by the reference numeral 30, wherein extrusion holes 31 are provided which are connected to the second channels for the passage of the first component and extend from a first region 32 for the distribution of the second component; the arrangement is such that the extrusion holes have, in an upward region, a flared region 33 followed by an intermediate portion 34 which ends in the narrower extrusion portion 35 which can, for example, be Y-shaped as shown in FIG. 12.

If the two components of the filament must be placed one inside the other, the extrusion holes 31 are axially aligned with the second channels, is while if the two components of the filament must be arranged side by side, the extrusion holes 31 are staggered with respect to the second channels for the passage of the first component.

The extrusion holes are arranged so as to produce a uniform distribution with respect to the holes that convey the second component, so that it is possible to achieve extrusion filaments in which there is a constant and preset ratio between the first component and the second component.

The first component and the second component, as mentioned, have completely different paths with respect to each other; moreover, the second component follows a plurality of paths which differ in their configuration but are shaped so as to obtain, for an equal flow-rate, an identical load loss for any path, so that constancy of the quantitative ratio between the first component and the second component at the outlet of the extrusion holes is ensured.

From the above description it is thus evident that the present invention achieves the intended aim and objects, and in particular a spinneret holder assembly is provided which allows to spin two or more components in preset quantitative ratios, utilizing an accurate design of the cross-sections and lengths of the paths so as to have an identical load loss for an equal flow-rate without thereby having to make each component follow the same path.

The invention thus conceived is susceptible of numerous modifications and variations, all of which are within the scope of the inventive concept; for example, flow-rates which are not identical but have selected values.

All the details may also be replaced with other technically equivalent elements.

In practice, the materials employed, as well as the contingent shapes and the dimensions, may be any according to requirements.

The disclosures in Italian Patent Application No. MI99A001460 from which this application claims priority are incorporated herein by reference.

What is claimed is:

1. A spinneret holder assembly for producing a continuous plastic multiple-component yarn with a preset component ratio, comprising, in a mutually superimposed arrangement: a plate for conveying a first component and at least one second component; a distribution plate with first channels for the passage of said first component and a first compensation element for said second component; a pre-spinneret with second channels for the passage of said first component which are aligned with said first channels and a second compensation element for said second component; and a spinneret with extrusion hole which are connected to said channels for the passage of said first component and extend from a region for the distribution of said second component; the paths followed by said first component and said at least one second component being different from one another with respect to their configuration, and the load loss of the various paths that are covered being identical for each component, for a constant ratio between the components of each filament that leaves said spinneret, and wherein said conveyance plate forms a distribution element for the passage of said first component which is fed by a first pump, a first duct for the passage of said second component fed by a second pump being further provided, said first compensation element provided in said distribution plate comprises a V-shaped manifold at the apex of which said duct for the passage of the second component is connected, multiple branches having a variable cross-section, so as to ensure constancy of the amount of second component fed into each one of the distribution branches, extending from said manifold.

2. The spinneret holder assembly according to claim 1, wherein said distribution branches are interposed between said first channels and do not interfere with them.

3. The spinneret holder assembly according to claim 1, wherein said second compensation element comprises a plurality of holes for the transfer of the second component from said distribution branches to said spinneret, all of said transfer holes having the same axial length and a variable cross-section according to their arrangement with respect to distribution branches.

4. The spinneret holder assembly according to claim 3, wherein said extrusion holes have, in an upward region, a flared portion followed by an intermediate portion which ends with a narrow extrusion portion, said flared portion being arranged uniformly with respect to said holes for the transfer of said second component.

5. The spinneret holder assembly according to claim 3, wherein said distribution branches are interposed between said first channels and do not interfere with them.

* * * * *